United States Patent [19]

Weigl et al.

[11] 4,093,271

[45] June 6, 1978

[54] BUCKLE FOR SAFETY STRAP FOR SKIS

[75] Inventors: Erwin Weigl, Brunn am Gebirge; Josef Svoboda, Schwechat, both of Austria

[73] Assignee: TMC Corporation, Zug, Switzerland

[21] Appl. No.: 744,938

[22] Filed: Nov. 24, 1976

[30] Foreign Application Priority Data

Nov. 26, 1975 Austria ..... 8990/75
Feb. 25, 1976 Austria ..... 1411/76

[51] Int. Cl.[2] ..... A63C 9/08
[52] U.S. Cl. ..... 280/637; 24/230 R
[58] Field of Search ..... 280/637; 24/230 R, 75

[56] References Cited

U.S. PATENT DOCUMENTS

| | | | |
|---|---|---|---|
| 1,701,970 | 2/1929 | Chauward | 24/230 R |
| 3,844,000 | 10/1974 | Hedu | 24/230 R |
| 3,848,299 | 11/1974 | Gray | 24/230 R X |

FOREIGN PATENT DOCUMENTS

| | | | |
|---|---|---|---|
| 2,201,085 | 7/1973 | Germany | 280/637 |

*Primary Examiner*—Joseph F. Peters, Jr.
*Assistant Examiner*—Gene A. Church
*Attorney, Agent, or Firm*—Blanchard, Flynn, Thiel, Boutell & Tanis

[57] ABSTRACT

A buckle device for a safety strap for use with skis. The buckle device is comprised of a housing having a cavity therein and a slotlike opening providing communication to the cavity. The upper wall of the cavity is defined by a resilient tab having a push button or the like thereon to facilitate a flexing of the tab downwardly into the cavity. A catch part having generally the thickness corresponding to the width of the slotlike opening in the housing is adapted to be slid through the slotlike opening in the housing so that the free end of the catch part becomes positioned within the cavity in the housing. The catch part has a flexible tab thereon forming a barb or hook which, upon entry into the cavity, will engage a projection in the cavity to prevent a removal of the catch part from the cavity. A depressing of the push button will effect an engagement between the upper wall of the cavity and the barb or hook to locate the barb or hook in alignment with the slotlike opening. Once this alignment has occurred, the catch part can be pulled from the cavity.

7 Claims, 5 Drawing Figures

BUCKLE FOR SAFETY STRAP FOR SKIS

FIELD OF THE INVENTION

The invention relates to a buckle for a safety strap for skis having a straplike part which is secured at one end to the ski or an element which is fixedly connected to the ski, for example on a ski binding part, and at the other end placed around the ski boot or around the foot of the skier and releasably closed by means of the buckle. The two parts of the buckle are each connected to one of the free ends of the straplike part. The buckle has a housing into which a resiliently supported tongue can be moved and engages the housing under spring action and a button, key or the like is arranged on the housing by which the engaged position of the tongue can be cancelled by pressing down on the button or the like.

BACKGROUND OF THE INVENTION

Buckles for safety straps of this type are known but in different constructions. A buckle of the described type is published in German Gebrauchsmuster No. 1,974,922. This known construction relates to a belt buckle, in which the resiliently supported tongue is formed on a backwardly bent sheet metal part so that approximately in the center part of the housing a downwardly extending locking nose is constructed and forms the locking connection with the tongue which projects upwardly in the engaged condition. To effect a disengagement, a button which projects centrally above the housing is pressed down, which button holds down with bent webs the upright part of the tongue so that it can be pulled out of the housing and thus the connection of the two parts can be cancelled.

Such a buckle is difficult to use for safety straps because in safety straps for skis, the two buckle parts preferably must have a curved configuration, in order to better adjust to the boot surface or the foot of the skier. For this purpose, the arrangement of a relatively large push button with webs which are arranged spaced from one another at a considerable distance would therefore be disadvantageous. Also, the construction of the centrally arranged catch nose cannot be considered to be purposeful because only half the length of the tonque is used. Thus the entire buckle must have a relatively long length which is also disadvantageous in the case of safety straps. A movement of the push button toward the area of the housing, which area is in front in the opening direction, is not possible in the known solution because in this manner the front part of the tongue (also viewed in opening direction) could no longer be pressed down in a sufficient manner or — which is also disadvantageous — the material would have to be stressed too much, which would cause a premature wear of the buckle.

According to British Patent No. 818,988, the push button is mounted on a springy designed part of the housing, on which is provided an upwardly projecting catch nose which cooperates with a recess of the non-springy tongue. In the inserted position of the tongue, the recess comes into engagement with the catch nose, which engagement can be cancelled by pressing down the push button so that the tongue can be pulled out of the housing. The push button can thereby be operated through an opening of the housing. To limit the path of operation of the push button, a web having bent portions is provided inside of the housing.

The housing consists of relatively many parts, so that the manufacture of the buckle requires much work and is expensive. In this structure, the design is a reversal of the first-discussed design in that here the springy part is mounted inside of the housing.

In a further known construction according to German Patent No. 271,782, the spring is also provided inside of the housing and the part to be introduced into the housing is formed as a button which is I-shaped in cross-section. The lower head plate of the button is loaded by the spring after engagement is brought about with the downwardly projecting projections of the housing. To cancel the lock, a pressure is exerted onto the upper head plate of the button which causes the lower head plate to press the spring down to cancel the engagement of the lower head plate with the projections and the closing part can be moved out of the housing.

A disadvantage of this known construction consists in the slightly complicated arrangement of the spring within the housing, furthermore in the stem of the button and the head plate having to be adjusted very exactly to the associated areas of the inside of the housing, to exclude fautly engaging conditions. If now, as already discussed above, in the case of a safety strap buckle the two parts require a curvature in addition, then a secure lock could be achieved only yet in a more complicated manner.

Finally in the case of a safety element according to German OS No. 2,217,378 (FIG. 11) a construction is known in which the tongue, which is introduced through an opening in the housing, can be brought into engagement with a catch hook pivotal about an axis which lies transversely with respect to the direction of introduction and engages with its nose a corresponding recess of the safety element. In this known construction, the spring hook is resilient.

A disadvantage of this construction lies in an additional catch hook and a pivot axis being needed aside from the housing and the tonque.

The object of the invention is to provide for a safety strap of the abovementioned type a buckle which does not have the mentioned disadvantages but wherein the security of the buckle is assured.

The purpose of the invention is attained by providing a housing, as is actually known, which has a resiliently supported part which, in the closed condition of the buckle, is loaded by an inserted, resiliently supported tongue.

Due to the fact that the resiliently supported tongue cooperates with a resiliently supported part of the housing, a secured lock is offered because the resiliently supported closing part has to adjust to a flexible part and thus practically the entire spring power is used to increase the depth of engagement or to maintain the closing position.

An advantageous form of the inventive buckle device lies in the resiliently supported part of the housing being formed in the housing lid. In this manner the housing is designed in a particularly simple way.

In order to design the buckle yet simpler, according to a further characteristic of the invention the button, the key or the like can be mounted on the resiliently supported part of the housing, preferably can be constructed in one piece with same.

A further thought of the invention lies in the fact that in the closed position of the buckle the tongue rests on the front inner edge of the housing viewed in opening direction. This construction has the advantage that the entire tongue length acts as a springy element and it is brought into the engagement position and carries out the largest path positioning movement between the pressed-down position and the engaging position.

A still further thought of the invention lies in the button, the key or the like being mounted on the area of the resiliently supported part of the housing, which lies above the free end of the resiliently supported tongue. This assures that the pressing down of the resiliently supported part of the housing occurs in an area which has to carry out the largest path to disengage the tongue.

An erroneously reversed or upside down insertion of the catch part is not possible. If this were not the case, the skier comes to expect a functional connection of the two parts of the buckle on the safety strap because during attaching of the safety strap, a practically unloaded condition exists and the springy action of the tongue is sufficient to falsely indicate the closing of the two parts. However, if a safety release occurs and a true load is created, then the buckle which is held together merely by friction opens up which causes not only the ski to be lost, but also an accident can be caused. This can take place particularly in those devices in which the housing is closed from below. The projection which exists in the case of an open bottom in the lower area of the housing can in turn lead to an unintended engagement between the tongue and the projection. A closing condition is created in this case, however, an opening of the buckle engaging the foot is very complicated.

This will be overcome according to a further characteristic of the invention by constructing inside of the housing a step which extends alongside of the housing, and by the body of the catch part having a step corresponding with said step, at least the sum of the heights of the two steps is larger than the free space between the opening of the housing and the height dimension of the area of the catch part which is to be introduced into the housing.

By using a step both in the housing and also on the catch part, it is assured that the catch part can only be introduced into the housing in the correct position, namely when the tongue lies in direction of the resiliently supported part of the housing. Since upon an intended introduction of a catch part in a position twisted at 180°, namely upside down, both the step of the housing and also the catch part are active and it is sufficient if the sum of the two steps is larger than the clearance existing in elevational direction between catch part and housing opening.

The step could basically also exist in the lid part of the inlet opening of the housing and at the front end of the catch part. The longitudinal dimensions of these parts are, however, small, so that it is advantageous, to design the step construction as discussed above.

BRIEF DESCRIPTION OF THE DRAWINGS

The invention will now be discussed more in detail in connection with the drawings, which illustrate two exemplary embodiments.

In the drawings:

FIG. 1 illustrates the closed or locked position of the buckle and FIG. 2 illustrates the buckle during disengagement of the parts;

DETAILED DESCRIPTION

Figure 1:
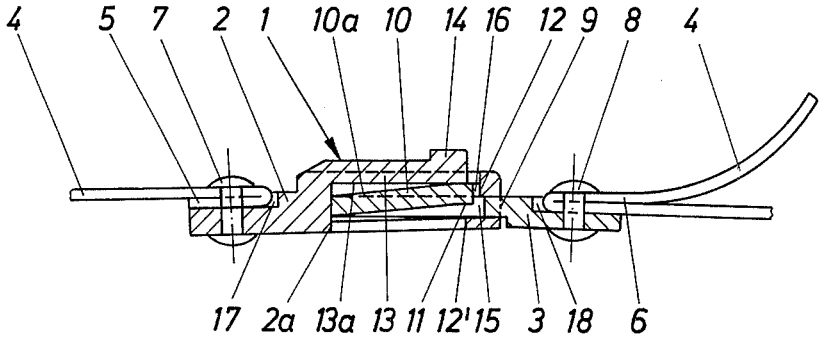
FIGS. 1 and 2 are both cross-sectional views of a first exemplary embodiment of the inventive buckle taken along a line I—I of FIG. 3, whereby
Figure 2:
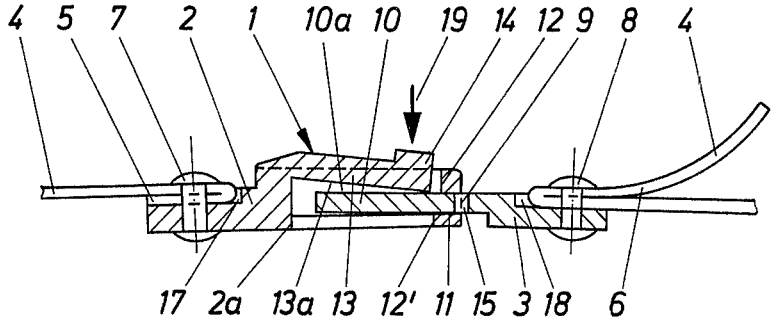
Figure 3:
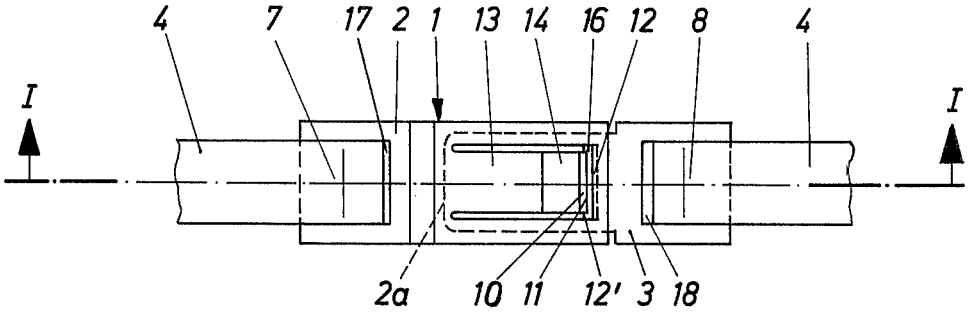
FIG. 3 is a top view of FIG. 1.

The buckle which forms the actual subject matter of the invention is identified as a whole by the reference numeral 1. The buckle 1 consists of a housing 2 and a catch part 3. Each of these parts is secured to one of the free ends 5,6 of a conventional safety strap 4 by means of rivets 7,8. The housing 2 has a cavity therein and has a slotlike opening 9 therein through which the catch part 3 is introduced into the cavity of the housing 2. A flexible springlike tongue or tab 10 is constructed in the front or free end area of the catch part 3 and, in the present exemplary embodiment, is made of the same material as the catch part 3. In the closed condition of the buckle 1, the free end 11 of the tongue 10 engages a projection or lip 12 on the housing 2. As can be recognized in FIG. 1, the upper surface 10*a* of the tongue 10 simultaneously engages the lower surface 13*a* of a resilient or springlike tab 13 on the housing 2. The tab 13 forms a lid over the cavity. The construction of the resilient springlike tab 13 of the housing 2 is shown in FIGS. 1 or 2 and FIG. 3. From these figures, one will also note the arrangement of a button, a key 14 or the like on the resilient tab 13 on the housing 2. A spacing 15 is provided between the free end 11 of the tongue 10 and the body of the catch part 3 in order to safely prevent a jamming of the free end of the tongue 10 against the body of the catch part. In a similar manner, a spacing 16 is also provided between the button, the key 14 or the like and the projection 12 of the housing 2. It is to be understood that the side edges of the tongue 10 or of the resilient part 13 are sufficiently spaced from the side parts of the housing 2 so that they are freely movable therebetween. The ends of the housing 2 or of the catch part 3 which, in the closed condition of the buckle 1, face away from one another, have stepped surfaces 17,18, in which the free ends 5,6 of the safety strap 4 are riveted in a conventional manner.

To close the buckle 1, the catch part 3 with its upwardly projecting resilient tongue 10 is introduced through the slotlike opening 9 of the housing 2 until the free end of the catch part 3 engages the front wall 2*a* of the housing 2. In this position, which is shown in FIG. 1, the tongue 10 springs freely upwardly within the housing 2, whereby the upper surface 10*a* engages the lower surface 13*a* of the resilient part 13 of the housing 2 and loads this part from below. Since the part 13 itself is also resiliently supported, the tongue 10 is not particularly stressed for cooperation with the housing part 13 and the entire spring force serves practically to maintain the closed position. This is achieved by the free end 11 of the tongue 10 engaging the projection 12 of the housing 2. The just now discussed loaded closing position differs from the position illustrated in FIG. 1, in that a spacing is created between the housing wall 2*a* and the front free end of the catch part 3. Such a position should be understood by a man skilled in the art without any further discussions.

FIG. 2 illustrates the position, where the button, the key 14 or the like is pressed down by an outside force, which is schematically indicated by an arrow 19. This occurs mostly by a pressure of the finger of the skier. The lower surface 13*a* of the resiliently supported part 13 exerts a corresponding force onto the tongue 10 of the catch part 3 so that the free end of the tongue 10 becomes aligned with the opening 9 and the catch part 3 can be pulled out of the housing. The pulling function is done automatically in many safety straps, because the part of the safety strap gripping around the ski boot or the foot of the skier is equipped in a conventional manner with a rubber cord (not illustrated) and the retractive force of the rubber cord will pull the tongue 10 from the housing 2.

FIG. 3 illustrates a top view of FIG. 1, which shows in greater detail the construction of the resiliently supported part 13 of the housing 2 or of the button, the key 14 or the like. A lower projection 12' is provided on the housing 2 which is offset inwardly compared to the upper projection 12 in order to prevent a use of the catch part 3 contrary to instructions and which would make an opening of the buckle very difficult. If namely the catch part 3 is introduced into the housing 2 and rotated 180° or upside down from that shown in FIG. 1, the tongue 10 will not reach engagement with, that is project beyond, the lower projection 12' and the buckle 1 will not close. In constructions, where a rubber cord is provided, the housing 2 and the catch part 3 will move automatically apart immediately informing the user of the error in alignment.

Figure 4:
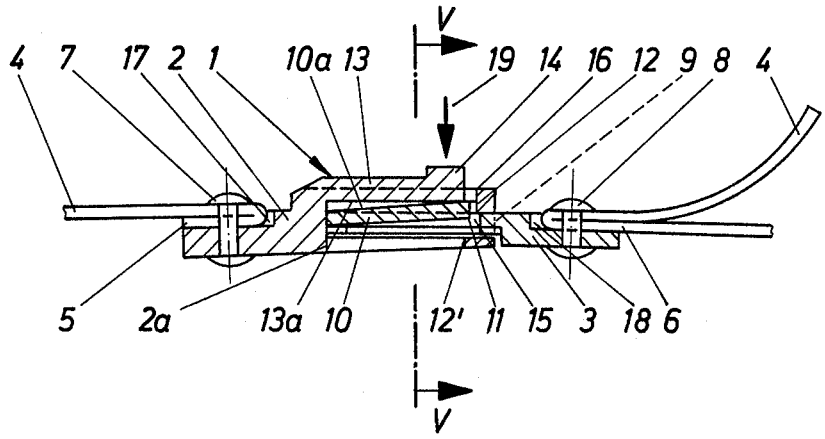
FIG. 4 is a longitudinal cross-sectional view taken along the line IV—IV of FIG. 5.
Figure 5:
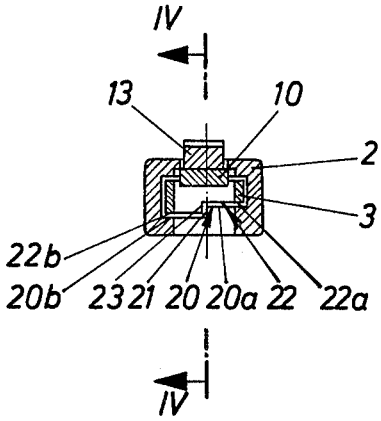
FIG. 5 is a cross-sectional view taken along the line V—V of FIG. 4.

As can particularly be recognized from FIGS. 4 and 5, a step 21 is provided in the floor 20 of the housing 2, which step extends in the longitudinal direction of the housing 2. The floor 22 of the catch part 3 has a step 23 which corresponds and cooperates with the step 21 of the housing 2. Thus the floor part **20*a* of the floor 20 is in FIG. 5 higher on the right-side than on the left-side floor part 20*b* and the right-side bottom surface 22*a* of the bottom 22 of the catch part 3 is higher than the left-side bottom surface 22*b*. FIGS. 4 and 5 show the catch part 3 in the correct position in and relative to the housing 2**.

Should now an attempt be made to introduce the catch part 3 in a position rotated 180° or upside down into the opening 9 of the housing 2, this would not be possible as this will be recognized even without illustration because the inwardly elevated floor part **20*a* of the housing 2 and the bottom surface 22*b* of the catch part 3, which bottom surface 22*b*** faces upwardly in this position, prevent an engagement between the two parts.

The invention is not limited to the illustrated exemplary embodiment. Variations are possible without departing from the scope of the subject matter of the invention. For example, the button, the key or the like does not need to be made of the same material of the housing, but can be inserted into and screwed or glued to the housing 2 or it can be secured in a different desired manner. Preferably, the housing and the catch part may be made of a plastic material; it is also conceivable to use other materials and to also make one of the parts of a different material than the other part.

As already mentioned, the steps can be provided also on the lid part of the inlet opening of the housing or on the upper area of the catch part framing. However, it is also conceivable to design the step in the form of a wedge with a counterpiece having a corresponding groove. It is unimportant whether the groove is constructed on the catch part and the wedge in the housing or vice versa, however, it is considered to be advantageous to provide the groove on the catch part to avoid damage to the catch part.

It is, however, also conceivable to provide a symmetric design, by providing wedges or ribs on the edge areas of the guide part and by constructing the steps on the frame of the catch part. As already mentioned, a reversal of the wedge and groove can also be utilized.

It is, however, also not absolutely necessary, to provide the two guide parts at the bottom or on the lid, a lateral guideway may also be provided instead. The height of the wedge must then be dimensioned such that same is greater than the lateral clearance between catch part and housing opening.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A buckle for use with a safety strap to effect a securement of a skier to a ski, comprising:

a first buckle part having means defining a housing thereon, said housing having spaced side walls and spaced end walls, the spacing between said walls defining a cavity therebetween, means defining a passageway in one of said end walls extending from the exterior of said housing into said cavity, stationary lip means adjacent one side of said passageway and facing inwardly of said cavity, at least one of said side walls adjacent said lip means being defined by a first resiliently flexible tab formed on said housing and anchored thereon adjacent said end wall remote from said end wall having said passageway therein, said first tab being pivotal about the anchor point from a normal position spaced from said lip means into said cavity so that the free end thereof is movable into said cavity past said lip means, the resiliency of said first tab effecting a return thereof to said normal position; and a second buckle part having a flat annular frame with a central opening therein and a second resiliently flexible tab extending into said opening from one edge of said annular frame, said second tab being formed to normally project out of the plane of said annular frame at the free end thereof and being flexible out of the normal position into the plane of said annular frame, said second buckle part being received in said passageway and said cavity with said one edge of said frame being positioned adjacent said one end wall of said housing and said free end of said second tab projecting toward said one side wall of said housing and said free end of said first tab past said lip means, said free end of said second tab engaging said lip means to prevent withdrawal of said second buckle part from said cavity, said first tab being resiliently flexed into said cavity and into engagement with said second tab to effect a movement of said second tab out of said normal position into said plane of said annular frame to position said second tab in alignment with said passageway and out of alignment with said lip means for removal of said second buckle part from said first buckle part.

2. The improved buckle according to claim 1, including a raised button on said first tab in the area adjacent the free end of said first tab and facing outwardly of said housing.

3. The improved buckle according to claim 1, wherein in said cavity a first step is provided in one of said side walls and extends between said end walls and terminates at said opening, and wherein said annular frame also has a second step which corresponds in shape with said first step, the maximum thickness of said second buckle part is greater than the minimum size of said passageway in said housing so that said first and second steps must be properly aligned before said first buckle part can become coupled to said second buckle part.

4. The improved buckle according to claim 3, wherein said first step is provided on the wall of said housing opposite said first tab and lying in a vertical plane of symmetry.

5. The improved buckle according to claim 3, wherein said first step is provided on the end wall having said passageway therein .

6. The improved buckle according to claim 3, wherein said cavity is constructed in form of a wedge and wherein said second buckle part has a wedge shape to conform to the shape of said cavity.

7. The improved buckle according to claim 1, wherein the one of said side walls opposite said first tab and adjacent said passageway has limiting means for limiting the movement of said second tab from said normal position thereof so that said second tab will be assured of alignment with said passageway upon engagement with said limiting means.

* * * * *